US006301843B1

(12) United States Patent
Silverman

(10) Patent No.: US 6,301,843 B1
(45) Date of Patent: Oct. 16, 2001

(54) MUNTIN JOINT

(75) Inventor: Arthur Silverman, Warren, NJ (US)

(73) Assignee: Silver Line Building Products Corp., North Brunswick, NJ (US)

( * ) Notice: Subject to any disclaimer, the term of this patent is extended or adjusted under 35 U.S.C. 154(b) by 0 days.

(21) Appl. No.: 09/542,372

(22) Filed: Apr. 4, 2000

(51) Int. Cl.[7] ..... E06B 3/00

(52) U.S. Cl. ..... 52/204.5; 52/656.6; 52/204.7; 52/456

(58) Field of Search ..... 52/456, 665; 403/326, 403/329, 294, 282, 317, 292

(56) References Cited

U.S. PATENT DOCUMENTS

| | | | |
|---|---|---|---|
| 752,831 | 2/1904 | Emerson . | |
| 2,354,054 | 7/1944 | Plym | 287/51 |
| 2,604,196 | 7/1952 | Peremi et al. | 189/76 |
| 3,226,897 | 1/1966 | Dorman | 52/475 |
| 3,345,791 | 10/1967 | Shinefeld | 52/616 |
| 3,603,628 | 9/1971 | Smith et al. | 287/189.36 H |
| 3,686,814 | 8/1972 | Anderson | 52/456 |
| 4,027,453 | 6/1977 | Bridge | 403/353 |
| 4,665,663 | 5/1987 | Governale | 52/456 |
| 4,702,055 * | 10/1987 | Ralph | 52/456 |
| 4,845,911 * | 7/1989 | Winston | 52/456 |
| 4,861,183 | 8/1989 | Loos | 403/354 |
| 5,313,761 | 5/1994 | Leopold | 52/788 |
| 5,351,459 * | 10/1994 | Kassl et al. | 52/656.5 |
| 5,657,590 | 8/1997 | Digman et al. | 52/204.61 |
| 5,678,376 | 10/1997 | Poma | 52/656.8 |
| 5,791,102 * | 8/1998 | Sheath | 52/204.7 |

* cited by examiner

*Primary Examiner*—Carl D. Friedman
*Assistant Examiner*—Steve Varner
(74) *Attorney, Agent, or Firm*—Lerner, David, Littenberg, Krumholz & Mentlik, LLP

(57) ABSTRACT

A muntin connector includes male and female connecting members each having a length, a thickness, and a width greater than the thickness. The connecting members are configured to be assembled together in a direction transverse to the length and width directions so that the connecting members cannot be disassembled by pulling apart in the length direction.

27 Claims, 4 Drawing Sheets

MUNTIN JOINT

FIELD OF THE INVENTION

The present invention relates generally to muntin bar assemblies and, more particularly, to a connector for making an orthogonal joint between two muntin bars.

BACKGROUND OF THE INVENTION

Older colonial style homes frequently had windows which consisted of an assembly of smaller glass panes separated from one another by horizontal and vertical wooden strips or muntin bars. Modern construction has emulated the decorative appearance of these muntin bars by assembling a false muntin bar assembly adjacent a single pane of glass or between the glass panes in an insulating glass unit to give the appearance that the glass is formed from a number of smaller window panes separated from one another. These false muntin bar assemblies typically consist of a series of flattened tubular components, ordinarily formed from metal or plastic, joined together in horizontal and vertical directions to form a latticework. Retaining clips may be used to secure the free ends of the muntin bar assembly to the window frame. The retaining clips generally include a first portion which fits snugly within the hollow end of the muntin bar, and a second portion which connects to the window frame or to the spacer frame sandwiched between the glass panels of an insulating glass unit.

When a muntin bar extending in a vertical orientation intersects a muntin bar extending in a horizontal orientation, a connector may be used to hold the two muntin bars in assembled relationship. In a typical arrangement, the muntin bars in one series, for example the vertical series of muntin bars, extend continuously between opposite sides of a window frame, with each such muntin bar including apertures extending transversely therethrough at the positions where they are to intersect with horizontal muntin bars. The horizontal muntin bars may be formed in segments sized to fit between the window frame and the nearest vertical muntin bar, or between two consecutive vertical muntin bars. The horizontal muntin bar segments may be assembled to the vertical muntin bars by a muntin connector, such as the conventional prior art connector 10 shown in FIG. 1. Muntin connector 10 includes a male connecting portion 12 and a female connecting portion 14. Male connecting portion 10 includes an elongated spine 16 having a pair of fingers 18 and 20 formed at end 22 thereof. A slot 24 formed between fingers 18 and 20 enables the fingers to deflect toward one another during the connection of male connecting member 12 to female connecting member 14. A pair of lugs 26 and 28, formed on the ends of fingers 18 and 20, respectively, define laterally projecting latch surfaces 30 and 32 which, as described below, engage mating surfaces on female connecting member 14 to hold the connecting members in assembled relationship. At its opposite end 34, spine 16 includes a plurality of fins 36 projecting laterally from opposite sides thereof. Fins 36 are angled toward end 22 of connecting member 12 so as to resist the removal of the connecting member once it has been inserted into a muntin bar segment. Connecting member 12 also includes a pair of arms 38 and 40 which project laterally from spine 16 so as to define a pair of coplanar stop surfaces 42 and 44 at a predetermined distance from the end 22 of the connecting member.

The female connecting member 14 may include a central body 46 having an opening 48 formed at end 50 thereof. Opening 48 is sized and shaped so that fingers 18 and 20 deflect toward one another upon insertion of end 22 of connecting member 12 into opening 48. Apertures 52 and 54 formed through body 46 intersect opening 48 and define ledges 56 and 58 for mating with the latch surfaces 30 and 32 formed on the free ends of fingers 18 and 20. Female connecting member 14 also includes a plurality of fins 60 projecting laterally from opposite sides of body 46. As with fins 36 on connecting member 12, fins 60 are angled toward end 50 of connecting member 14 so as to resist the removal of the connecting member after it has been inserted into a muntin bar segment. A pair of arms 62 and 64 project laterally from body 46 and define a pair of coplanar stop surfaces 66 and 68 coextensive with end 50 of connecting member 14.

Muntin connector 10 may be used as follows to connect two horizontal muntin bar segments to a vertical muntin bar. Firstly, connecting member 12 is inserted through a transverse aperture in the vertical muntin bar until stop surfaces 42 and 44 contact one longitudinal edge of the muntin bar with fingers 18 and 20 protruding from the opposite longitudinal edge. Connecting member 14 may then be assembled over fingers 18 and 20 of connecting member 12 until latch surfaces 30 and 32 on the fingers engage ledges 56 and 58 in opening 48, locking the two connecting members together. At this point, the stop surfaces 66 and 68 on connecting member 14 will contact or be in very close proximity to the longitudinal edge of the vertical muntin bar opposite connecting member 12 so that the vertical muntin bar is sandwiched between the connecting members. The horizontal muntin bar segments are then assembled over the exposed portions of connecting members 12 and 14 and pushed toward and against the vertical muntin bar to form a gapless connection. In this regard, the width and thickness of connecting members 12 and 14 are dimensioned to create a snug friction fit engagement within the horizontal muntin bar segments, thereby providing a secure assembly of the horizontal muntin bar segments to the vertical muntin bar.

Although muntin bar connector 10 provides a neat and secure connection between vertical and horizontal muntin bars, it creates difficulties should the muntin bars need to be disassembled from one another, as may be the case where a muntin bar is defective or becomes damaged during window assembly. Thus, for example, to remove a horizontal muntin bar segment, a pulling force is exerted on the muntin bar segment in an effort to slide it off the connecting member on which it is assembled. However, because the frictional force between the muntin bar segment and the underlying connecting member is frequently greater than the force holding connecting members 12 and 14 together, attempts to remove a horizontal muntin bar segment from the underlying connecting member often result in the disassembly of the muntin connector. When that occurs, the end 22 of connecting member 12 protrudes from the end of the muntin bar segment and can be easily grasped to remove the connecting member from the muntin bar segment. Although this is not a difficult procedure, it adds to the overall time required to complete a muntin bar assembly. Connecting member 14, on the other hand, will lie entirely within the muntin bar segment, and as a result requires special tools for removal. This is a time-consuming process, increasing the cost of manufacture. To maintain manufacturing speed, connecting member 14 may simply be discarded along with the its associated muntin bar segment, again at an increase in manufacturing costs.

There therefore exists a need for a muntin connector having components which are easily assembled to one another, but which allow muntin bar segments to be removed therefrom without the components becoming disassembled.

SUMMARY OF THE INVENTION

The present invention addresses these needs.

One aspect of the present invention provides a connector for joining a pair of muntin bars having hollow ends in transverse relationship to a third muntin bar. In one embodiment, the connector includes a first connecting member having a body, a connecting portion extending in an elongation direction from the body to one end, and a holding portion extending from the body to another end in a direction opposite the elongation direction. The connecting portion has an engagement surface intermediate the body and the one end, the engagement surface being oriented in a direction transverse to the elongation direction and being nondeformable relative to the connecting portion in the direction transverse to the elongation direction. The holding portion has a cross-section which is sized to fit snugly in an end of one of the pair of muntin bars.

The connector further includes a second connecting member having a mating end and a second end. The second connecting member includes a stop surface oriented in a direction transverse to the elongation direction, and is nondeformable in the direction transverse to the elongation direction. The cross-section of the second connecting member is such as to fit snugly in an end of another one of the pair of muntin bars. The first and second connecting members are adapted to be joined together with the stop surface intermediate the body and the engagement surface on the first connecting member so that, when joined, the connecting members can not be disassembled by pulling the connecting members away from one another in the elongation direction. The engagement surface may be positioned at a predetermined distance from the body and the stop surface may be positioned at the same distance from the mating end of the second connecting member.

In another embodiment in accordance with this aspect of the present invention, the connector consists of a first connecting member including a first portion having a width and a thickness, the width being greater than the thickness, and a connecting portion extending from the first portion in a length direction. The connector also includes a second connecting member having a width and a thickness, the width being greater than the thickness, and a receiving portion. The first and second connecting members are adapted to be assembled in the direction transverse to the width and length directions to engage the connecting portion with the receiving portion in assembled relationship.

In either embodiment, the connector may further include a pair of fins projecting outwardly from the holding portion and/or the second connecting member in directions transverse to the elongation direction. The fins may include a first series of fins projecting outwardly from one side of the holding portion and/or the second connecting member in a first direction transverse to the elongation direction, and a second series of fins projecting outwardly from the other side of the holding portion and/or the second connecting member in a second direction transverse to the elongation direction.

In preferred embodiments, the connecting portion may include a finger projecting in the elongation direction from the first end of the body, and the second connecting member may include a receiving channel extending in the elongation direction and having a width sized to receive the finger in the assembled position. The finger may include a first segment having a selected width in a direction perpendicular to the elongation direction and a second segment between the body and the first segment having a width which is narrower. Further, the receiving channel may include a pair of opposed retaining members resiliently displaceable in opposite directions for inserting the finger in the channel in the assembled position.

Another aspect of the present invention provides a muntin bar assembly. The muntin bar assembly consists of a plurality of muntin bars arranged in a plane and having a length extending in an orientation direction in the plane. Each of the muntin bars has first and second longitudinal edges and a series of slots extending between the longitudinal edges at spaced positions along the length. The assembly further includes a connector assembled in each of the slots, each connector including first and second connecting members. In one embodiment hereof, the first connecting member has a holding portion projecting from the first longitudinal edge of one of the muntin bars and a connecting portion extending in an elongation direction from the holding portion through the slot. The connecting portion includes an engagement surface spaced from the second longitudinal edge of the muntin bar and oriented in a direction transverse to the elongation direction, the engagement surface being nondeformable relative to the connecting portion in the direction transverse to the elongation direction. The second connecting member is assembled to the connecting portion and has a stop surface positioned between the engagement surface and the second longitudinal edge of the muntin bar. The stop surface is oriented in a direction transverse to the elongation direction and is nondeformable in the direction transverse to the elongation direction so that the connecting members cannot be disassembled by pulling the connecting members away from one another in the elongation direction. A plurality of muntin bar segments are assembled to the connectors, at least some of the muntin bar segments having one end connected to a holding portion extending from one muntin bar and another end connected to a second connecting member extending from an adjacent muntin bar to connect the muntin bars together.

In another muntin bar assembly in accordance with this aspect of the present invention, the connector assembled in each of the slots includes first and second connecting members, the first connecting member having a first portion with a width which is greater than its thickness. The second connecting member has a receiving portion and a width which is greater than its thickness. The first and second connecting members are assembled in a direction transverse to the width and length directions to engage the connecting portion with the receiving portion.

In preferred embodiments, the first connecting members may have a thickness which is greater than the thickness of the slots in the muntin bars. Similarly, the second connecting members may have a thickness which is greater than the thickness of the slots in the muntin bars.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figure 1:
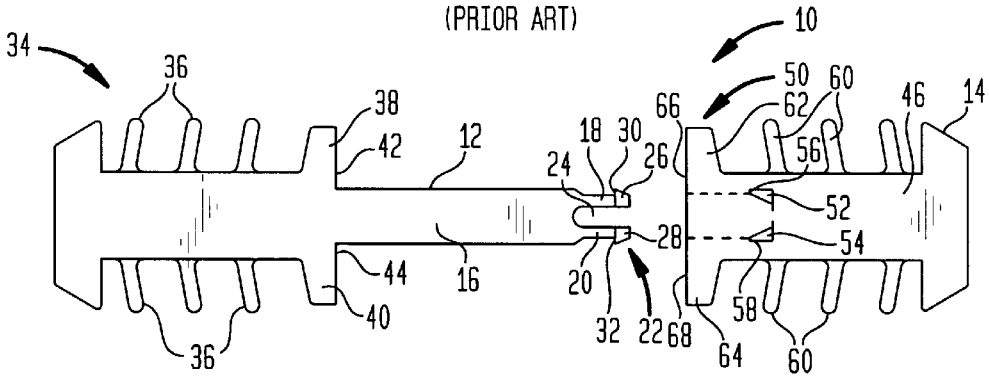
FIG. 1 (PRIOR ART)
FIG. 1 is a top plan view of a prior art muntin connector.
Figure 2:
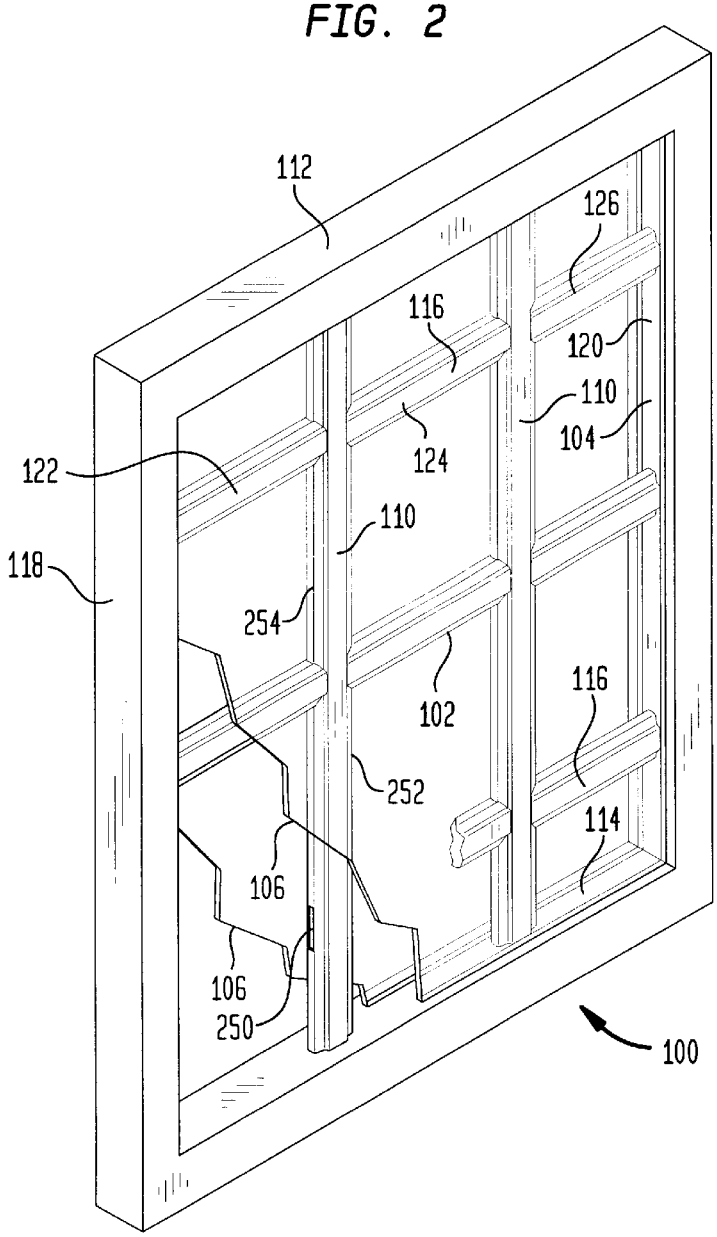
FIG. 2 is a perspective view of an insulating glass unit, partially broken away to show the muntin bar assembly incorporating the muntin connector of the present invention.
Figure 3:
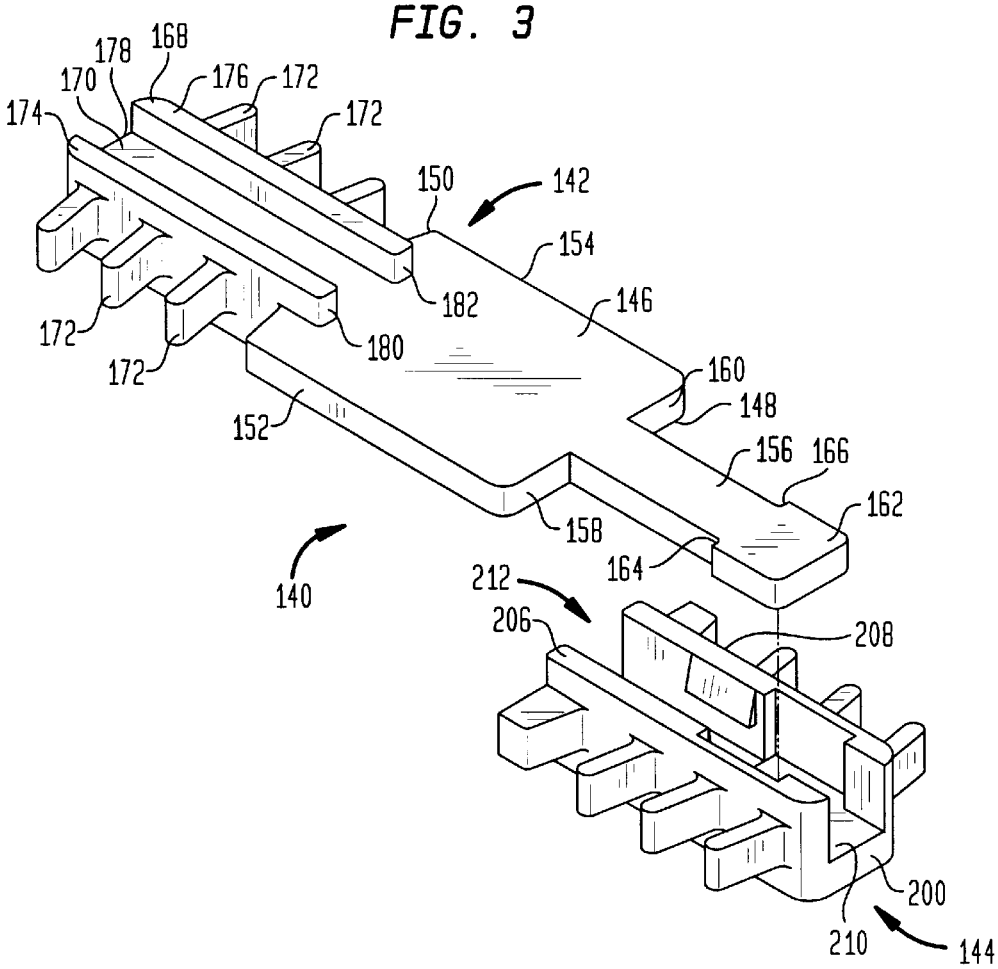
FIG. 3 is a perspective exploded view of the muntin connector of the present invention.
Figure 4:
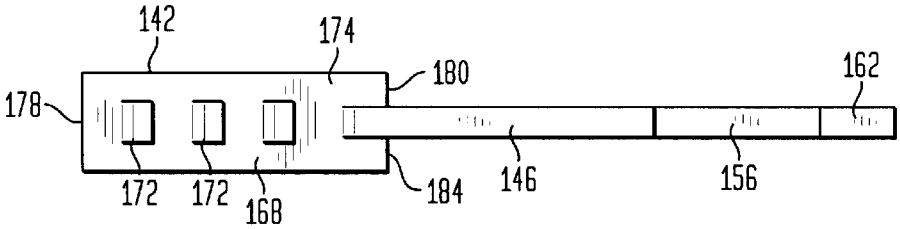
FIG. 4 is a side elevational view of the male portion of the muntin connector of FIG. 3.
Figure 5:
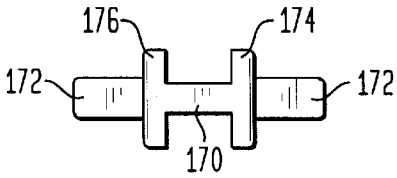
FIG. 5 is an end elevational view of the male portion of the muntin connector of FIG. 3.
Figure 6:
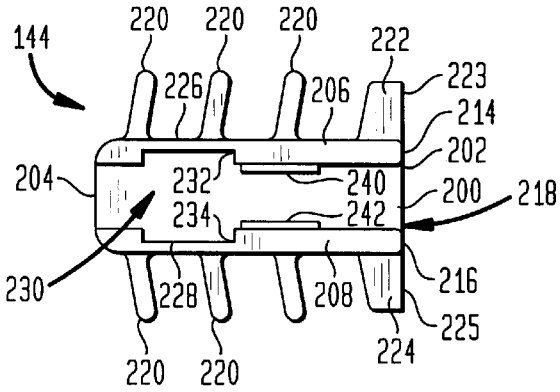
FIG. 6 is a top plan view of the female portion of the muntin connector of FIG. 3.
Figure 7:
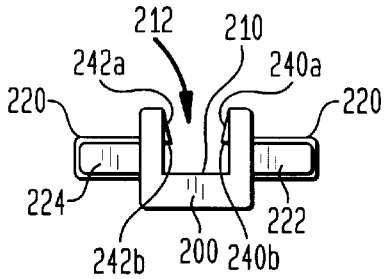
FIG. 7 is an end elevational view of the female portion of the muntin connector of FIG. 3.
Figure 8:
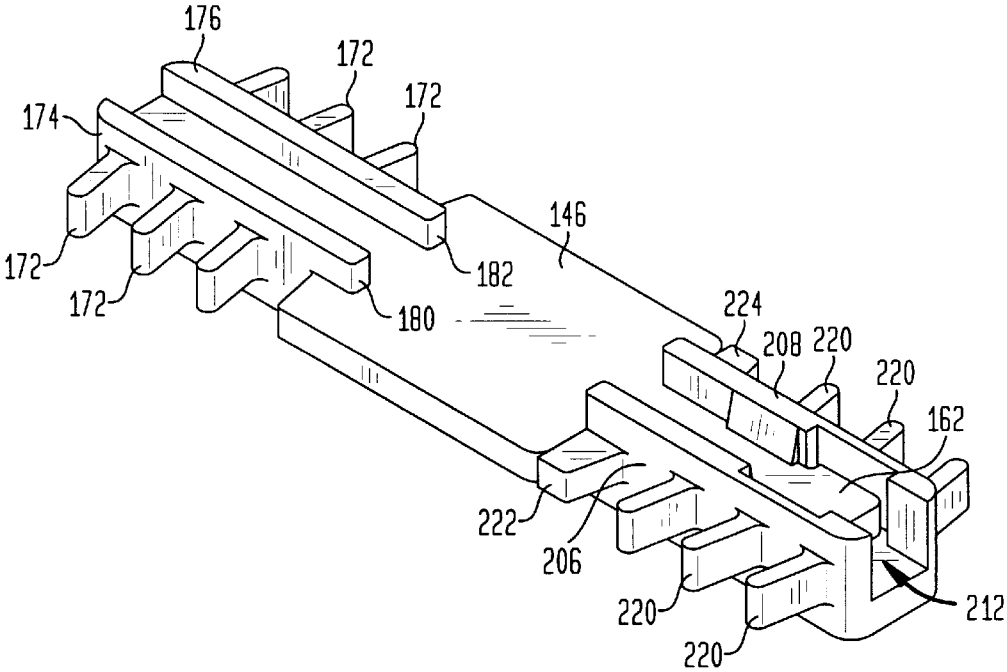
FIG. 8 is a perspective view of the muntin connector of FIG. 3 in assembled relationship.
Figure 9:
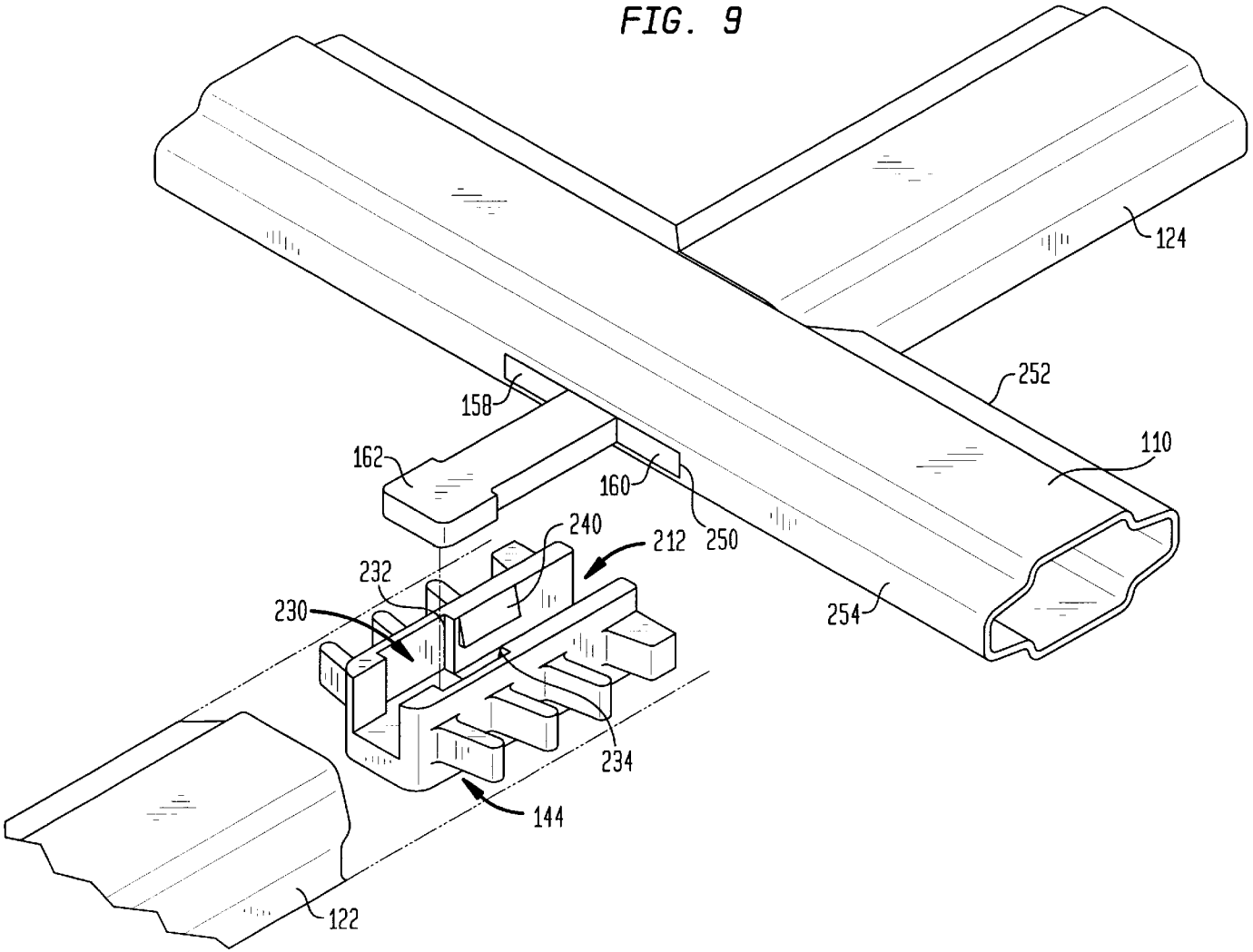
FIG. 9 is a partially exploded perspective view of a muntin joint in accordance with the present invention.

Referring to FIG. 2, there is illustrated an insulating glass unit 100 having a muntin bar assembly 102 constructed in accordance with the present invention. Unit 100 has a conventional structure including a spacer frame assembly 104 sandwiched between glass panes 106. A muntin bar assembly 102 is positioned between glass panes 106, with its ends assembled to spacer frame assembly 104 using conventional muntin clips (not shown). As illustrated, unit 100 is in condition for final assembly into a window or door frame (not shown) for ultimate installation in a building.

Muntin bar assembly 102 includes a first plurality of muntin bars 110 which extend continuously in a vertical direction between the top spacer frame member 112 and the bottom spacer frame member 114. A second plurality of muntin bars 116 extend in a horizontal direction between one side spacer frame member 118 and the other side spacer frame member 120. Horizontal muntin bars 116 are not continuous, but rather each consists of a series of muntin bar segments 122 and 126 assembled between the side spacer frame members and the nearest vertical muntin bar 110, and muntin bar segments 124 assembled between consecutive or adjacent vertical muntin bars 110. Where they intersect with vertical muntin bars 110, muntin bar segments 122, 124 and 126 may be connected thereto by muntin connectors 140 constructed in accordance with the present invention. Muntin bars 110 and muntin bar segments 122, 124 and 126 preferably have a hollow tubular construction, although the present invention could be used in connection with solid muntin bars 110 and muntin bar segments 122, 124 and 126 having hollow ends. It will be appreciated, of course, that rather than the arrangement of muntin bars and muntin bar segments described above, continuous muntin bars 110 may extend in a horizontal direction between opposed spacer frame members 118 and 120, with muntin bar segments 122, 124 and 126 assembled in a vertical direction between muntin bars 110 and opposed spacer frame members 112 and 114. It also will be appreciated that where a muntin bar assembly is used in connection with a conventional window having a single pane of glass assembled in a window frame, with no spacer frame assembly, the muntin bar assembly may be mounted directly to the window frame.

Muntin connector 140 preferably is formed from a resilient material, most preferably from a resilient plastic such as polypropylene, nylon or other like materials. As shown in FIGS. 3–8, muntin connector 140 includes a male connecting member 142 and a female connecting member 144, each of which has a generally rectangular configuration with a width which is greater than its thickness. Male connecting member 142 may have a generally flat body 146 having a first end 148, a second end 150, and a pair of sides 152 and 154. A first portion in the form of an elongated finger 156 may project from end 148 and delineate a pair of surfaces 158 and 160 on either side thereof. Finger 156 may have a substantially uniform width along its entire length, and may terminate in a head 162 having a width greater than the width of finger 156 so as to define surfaces 164 and 166 projecting laterally from the opposite sides of the finger. At the opposite end 150 of body 146, connecting member 142 may include a second or connecting portion 168 for joining the connecting member to a muntin bar segment. Connecting portion 168 may include a substantially flat member 170 extending outwardly from end 150 of body 146. Member 170 may include a plurality of fins 172 projecting laterally from opposite sides thereof and angled toward body 146. A pair of ribs 174 and 176 may extend generally perpendicularly to member 170 and along the side edges thereof from the end 178 of member 170 to a predetermined position inwardly of the end 150 of body 146. Ribs 174 and 176 have a height which is greater than the height of member 170 and body 146 so as to define a pair of stop surfaces 180 and 182 on one side of body 146 and another pair of stop surfaces 184 and 186 on the opposite side of body 146 (only stop surface 184 being shown). The height of ribs 174 and 176 and the width of connecting member 142 between the free ends of fins 172 are dimensioned to provide a snug friction fit of connecting portion 168 within muntin bar segments 122, 124 or 126.

Female connecting member 144 may consist of a generally flat bottom wall 200 having ends 202 and 204, and side walls 206 and 208 extending generally perpendicularly from one surface 210 thereof and defining a longitudinal channel 212 therebetween. Preferably, the ends 214 and 216 of side walls 206 and 208, respectively, are coextensive with end 202 of bottom wall 200, and collectively these ends define a connecting end 218 of member 144. Although channel 212 is illustrated as extending the entire length of connecting member 144 from connecting end 218 to end 204 of bottom wall 200, that need not be the case. Thus, connecting member 144 may include an end wall (not shown) separating an end of channel 212 from the second end 204 of the connecting member. A plurality of fins 220 may project outwardly from side walls 206 and 208 and be angled toward end 218 of connecting member 144. In addition, connecting member 144 may include a pair of laterally projecting arms 222 and 224. Desirably, the side edges 223 and 225 of projecting arms 222 and 224 lie in the plane of connecting end 218.

Side wall 206 may have a substantially uniform thickness along its entire length, with the exception of a thinned wall section 226 proximate the end 204 of connecting member 144. Similarly, side wall 208 may have a substantially uniform thickness along its entire length, with the exception of a thinned wall section 228 opposite thinned wall section 226. Together, thinned wall sections 226 and 228 create in channel 212 an enlarged recess 230 for receiving the head 162 on connecting member 142, as explained more fully below. The differential thickness between wall section 226 and the remainder of side wall 206 defines a step 232 at a predetermined distance from end 218 of connecting member 144. Similarly, the differential thickness between wall section 228 and the remainder of side wall 208 defines a step 234 at a predetermined distance from end 218 of connecting member 144. Preferably, steps 232 and 234 are at the same distance from the end of the connecting member, and more preferably at a distance substantially equal to the length of finger 156 from surfaces 158/160 to surfaces 164/166. Steps 232 and 234 are positioned so that, with finger 156 of connecting member 142 assembled in channel 212 of connecting member 144 and surfaces 158 and 160 abuting the end 218 of connecting member 144, surfaces 164 and 166 will be substantially in alignment with and engage steps 232 and 234.

Between enlarged recess 230 and the end 218 of connecting member 144, side walls 206 and 208 may include opposed retaining members 240 and 242. Each retaining member may have an inwardly tapered upper surface, as at 240*a* and 242*a*, to facilitate the assembly of finger 156 in channel 212, and a lower surface, as at 240*b* and 242*b*, which is substantially parallel to bottom wall 200. Lower surfaces 240*b* and 242*b* preferably are spaced from bottom wall 200 by a distance which is only slightly greater than the thickness of finger 156 so that finger 156 will be held firmly against bottom wall 200 when fully assembled in channel 212.

The foregoing construction of muntin connector 140 permits connecting members 142 and 144 to be readily joined together and to form a secure connection which does not easily come apart when the connecting members are pulled longitudinally away from one another. In a typical assembly procedure, the finger 156 and body 146 of a male connecting member 142 may be inserted through one of a series of transverse slots 250 formed in muntin bars 110. Connecting member 142 may be pushed through slot 250 until stop surfaces 180, 182, 184 and 186 on opposite sides of body 146 contact the longitudinal edge 252 of muntin bar 110, at which point surfaces 158 and 160 will be about even with or protrude slightly out from the other longitudinal edge 254 of muntin bar 110, and finger 156 will protrude completely out therefrom. Connecting member 144 may then be positioned below finger 156 so that the finger is aligned over channel 212 with head 162 aligned over recess 230. Connecting members 142 and 144 may then be assembled together simply by pressing finger 156 and connecting member 144 together. As the longitudinal edges of finger 156 engage the tapered surfaces 240*a* and 242*a*, retaining members 240 and 242 move resiliently away from one another, thereby permitting finger 156 to enter channel 212 until lower surfaces 240*b* and 242*b* snap over the top edge of finger 156. At this point, finger 156, and thus connecting member 142, will be securely assembled to connecting member 144. Once this connection has been made, muntin connector 140 will be secured in fixed relationship to muntin bar 110. That is, muntin connector 140 will be prevented from moving relative to muntin bar 110 in the longitudinal direction of the muntin bar by the engagement of body 146 through slot 250. Similarly, the engagement of stop surfaces 180, 182, 184 and 186 of connecting member 142 against longitudinal edge 252 of muntin bar 110, and the engagement of connecting end 218 of connecting member 144 against or closely adjacent the opposite longitudinal edge 254 of muntin bar 110 sandwiches the muntin bar between the connecting members and prevents the muntin connector from moving relative to the muntin bar in a direction transverse to the elongation direction of the muntin bar.

With muntin connector 140 securely assembled to muntin bar 110, one end of muntin bar segment 122 may be assembled over connecting member 144 in friction fit engagement. Similarly, one end of muntin bar segment 124 may be assembled in friction fit engagement over connecting portion 168 of connecting member 142. The remainder of muntin bar assembly 102 may be completed in a similar fashion, with a muntin connector 140 used at each position at which a muntin bar segment is to be connected to a muntin bar 110. Once fully assembled, muntin bar assembly 102 may be mounted in a conventional fashion to the frame elements of a standard window or between the glass panes of an insulating glass unit.

It will be appreciated from the foregoing description that numerous modifications may be made to the structure of connecting members 142 and 144 while still providing for their assembly in a direction transverse to their length and width directions so as to achieve an assembly which is not readily pulled apart upon the application of opposed longitudinal forces thereto. For example, enlarged head 162 need not be formed at the end of finger 156, but may formed at any position along the length thereof so long as finger 156 has a region of narrower width between head 162 and body 146 for defining surfaces 164 and 166. Moreover, head 162 may be configured to define only a single one of surfaces 164 and 166 projecting laterally from finger 156, although two such surfaces are preferred, one on each side of finger 156, so as to uniformly distribute the load applied to head 162 as a muntin segment is removed from connecting member 142 or 144. For added connective strength, finger 156 may include two or more heads 162 formed at spaced intervals along the length thereof. Of course, it will be appreciated that, for each change in the size, shape or position of head 162, a corresponding change is made to the size, shape and/or position of recess 230 in connecting member 144.

In a further variant of the present invention, finger 156 may be made with a substantially uniform width with one or more recesses formed on one or both longitudinal edges thereof. In such embodiment, connecting member 144 may include tabs projecting inwardly at corresponding locations from side walls 206 and/or 208.

In a still further embodiment, finger 156 may be formed with a boss projecting outwardly therefrom toward connecting member 144. Connecting member 144 may include an aperture in surface 210 of bottom wall 200, sized and shaped to receive the boss in mating engagement. Furthermore, connecting member 144 need not have a channel 212 and opposed retaining members 240 and 242, although such construction provides a mechanism for securely holding connecting members 142 and 144 together. In an alternate embodiment in which finger 156 is formed with a boss projecting outwardly therefrom toward connecting member 144, the boss may be press fit in an aperture in bottom wall 200 of connecting member 144 or may have an enlarged tip which locks the boss in the aperture. Still further structures for holding connecting members 142 and 144 securely together are contemplated herein and will be readily appreciated by those of ordinary skill in the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

What is claimed is:

1. A connector for joining a pair of muntin bars in transverse relationship to a third muntin bar, each one of said pair of muntin bars having hollow ends, said connector comprising a first connecting member having a body, a connecting portion extending in an elongation direction from said body toward one end, and a holding portion extending from said body toward another end in a direction opposite said elongation direction, said connecting portion having an engagement surface intermediate said body and said one end, said engagement surface being oriented in a direction transverse to said elongation direction and being substantially nondeformable relative to said connecting portion in said direction transverse to said elongation direction, said holding portion having a cross-section in a direction perpendicular to said elongation direction sized to fit snugly in an end of one of the pair of muntin bars; and a second connecting member having a mating end and a second end and including a stop surface oriented in a direction transverse to said elongation direction and being substantially nondeformable in said direction transverse to said elongation direction, said second connecting member having a cross-section in said direction perpendicular to said elongation direction sized to fit snugly in an end of another one of the pair of muntin bars;

said first and second connecting members adapted to be joined together in an assembled position with said stop surface intermediate said body and said engagement surface on said first connecting member so that, with said first and second connecting members in said assembled position, said connecting members can not be disassembled by pulling said connecting members away from one another in said direction opposite said elongation direction.

2. The connector as claimed in claim 1, wherein said connecting portion includes a finger projecting in said elongation direction from said first end of said body, said finger including a first segment having a selected width in a direction perpendicular to said elongation direction and a second segment between said body and said first segment having a width in said direction perpendicular to said elongation direction which is less than said selected width.

3. The connector as claimed in claim 2, wherein said second connecting member includes a receiving channel extending in said elongation direction and having a width sized to receive said finger in said assembled position.

4. The connector as claimed in claim 3, wherein said receiving channel includes a pair of opposed retaining members resiliently displaceable in opposite directions for inserting said finger in said channel in said assembled position.

5. The connector as claimed in claim 1, wherein said engagement surface is positioned at a predetermined distance from said body, and said stop surface is positioned at said predetermined distance from said mating end of said second connecting member.

6. The connector as claimed in claim 1, further comprising a plurality of fins projecting outwardly from said holding portion in directions transverse to said elongation direction.

7. The connector as claimed in claim 6, wherein said plurality of fins include a first series of fins projecting outwardly from one side of said holding portion in a first direction transverse to said elongation direction, and a second series of fins projecting outwardly from another side of said holding portion in a second direction transverse to said elongation direction.

8. The connector as claimed in claim 1, further comprising a plurality of fins projecting outwardly from said second connecting member in directions transverse to said elongation direction.

9. The connector as claimed in claim 8, wherein said plurality of fins include a first series of fins projecting outwardly from one side of said second connecting member in a first direction transverse to said elongation direction, and a second series of fins projecting outwardly from said second connecting member in a second direction transverse to said elongation direction.

10. A connector for joining a pair of muntin bars in transverse relationship to a third muntin bar, each one of said pair of muntin bars having hollow ends, said connector comprising a first connecting member including a first portion having a width and a thickness, said width being greater than said thickness, and a connecting portion extending from said first portion in a length direction; and a second connecting member having a width and a thickness, said width being greater than said thickness, and a receiving portion, said first and second connecting members adapted to be assembled in a direction transverse to said width and transverse to said length direction to engage said connecting portion with said receiving portion in an assembled relationship.

11. The connector as claimed in claim 10, wherein said connecting portion includes an engagement surface oriented in a direction transverse to said length direction, and said receiving portion includes a stop surface oriented in a direction transverse to said length direction, said engagement surface engaging said stop surface in said assembled relationship of said connecting portion and said receiving portion.

12. The connector as claimed in claim 11, wherein said connecting portion includes a finger projecting from said first portion in said length direction, said finger including a first segment having a selected width and a second segment between said first portion and said first segment having a width which is less than said selected width.

13. The connector as claimed in claim 12, wherein said stop surface is located so as to be intermediate said first portion and said engagement surface in said assembled relationship of said connecting portion and said receiving portion.

14. The connector as claimed in claim 11, wherein said connecting portion includes a finger projecting from said first portion in said length direction, and said receiving portion includes a channel extending in said length direction and having a width sized to receive said finger in said assembled relationship of said connecting portion and said receiving portion.

15. The connector as claimed in claim 14, wherein said channel includes a pair of opposed retaining members resiliently displaceable in opposite directions for inserting said finger in said channel in said assembled relationship of said connecting portion and said receiving portion.

16. The connector as claimed in claim 10, further comprising a plurality of fins projecting outwardly from said first portion in directions transverse to said length direction.

17. The connector as claimed in claim 16, wherein said plurality of fins include a first series of fins projecting outwardly from one side of said first portion in a first direction transverse to said length direction, and a second series of fins projecting outwardly from said first portion in a second direction transverse to said length direction.

18. The connector as claimed in claim 10, further comprising a plurality of fins projecting outwardly from said second connecting member in directions transverse to said length direction.

19. The connector as claimed in claim 18, wherein said plurality of fins include a first series of fins projecting outwardly from one side of said second connecting member in a first direction transverse to said length direction, and a second series of fins projecting outwardly from another side of said second connecting member in a second direction transverse to said length direction.

20. A muntin bar assembly, comprising a plurality of muntin bars arranged in a plane and having a length extending in an orientation direction in said plane, each of said muntin bars having first and second longitudinal edges and a series of slots extending between said longitudinal edges at spaced positions along said length;

a connector assembled in each of said slots, each connector including first and second connecting members, said first connecting member having a holding portion projecting from said first longitudinal edge of one of said muntin bars and a connecting portion extending in an elongation direction from said holding portion through said slot, said connecting portion including an engagement surface spaced from said second longitudinal edge of said muntin bar and oriented in a direction transverse to said elongation direction, said engagement surface being substantially nondeformable relative to said connecting portion in said direction transverse to said elongation direction, said second connecting member being assembled to said connecting portion and having a stop surface positioned between said engagement surface and said second longitudinal edge of said muntin bar, said stop surface being oriented in a direction transverse to said elongation direction and being substantially nondeformable in said direction transverse to said elongation direction so that said connecting members cannot be disassembled by pulling said connecting members away from one another in said direction opposite said elongation direction; and a plurality of muntin bar segments assembled to said connectors, at least some of said muntin bar segments having one end connected to a holding portion extending from one muntin bar and another end connected to a second connecting member extending from an adjacent muntin bar to interconnect said one muntin bar with said adjacent muntin bar.

21. The muntin bar assembly as claimed in claim 20, wherein said slots have a thickness in a direction perpendicular to said plane, and said holding portions of said first connecting members have a thickness in said direction perpendicular to said plane which is greater than said thickness of said slots.

22. The muntin bar assembly as claimed in claim 21, wherein said second connecting members have a thickness in said direction perpendicular to said plane which is greater than said thickness of said slots.

23. The muntin bar assembly as claimed in claim 20, wherein said slots have a thickness in a direction perpendicular to said plane, and said second connecting members have a thickness in said direction perpendicular to said plane which is greater than said thickness of said slots.

24. A muntin bar assembly, comprising a plurality of muntin bars arranged in a plane and having a length extending in an orientation direction in said plane, each of said muntin bars having first and second longitudinal edges and a series of slots extending between said longitudinal edges at spaced positions along said length;

a connector assembled in each of said slots, each connector including first and second connecting members, said first connecting member having a first portion projecting from said first longitudinal edge of one of said muntin bars and a connecting portion extending in a length direction from said first portion through said slot, said first portion having a width in a direction parallel to said plane and a thickness in a direction perpendicular to said plane, said width being greater than said thickness, said second connecting member having a receiving portion, a width in said direction parallel to said plane and a thickness in said direction perpendicular to said plane, said width being greater than said thickness, said first and second connecting members being assembled in a direction transverse to said width and transverse to said length direction to engage said connecting portion with said receiving portion; and a plurality of muntin bar segments assembled to said connectors, at least some of said muntin bar segments having one end connected to a first portion extending from one muntin bar and another end connected to a second connecting member extending from an adjacent muntin bar to interconnect said one muntin bar with said adjacent muntin bar.

25. The muntin bar assembly as claimed in claim 24, wherein said slots have a thickness in said direction perpendicular to said plane, and said thickness of said first portions is greater than said thickness of said slots.

26. The muntin bar assembly as claimed in claim 25, wherein said thickness of said second connecting members is greater than said thickness of said slots.

27. The muntin bar assembly as claimed in claim 24, wherein said slots have a thickness in said direction perpendicular to said plane, and said thickness of said second connecting members is greater than said thickness of said slots.

* * * * *